US007876296B2

(12) United States Patent
Jang et al.

(10) Patent No.: US 7,876,296 B2
(45) Date of Patent: Jan. 25, 2011

(54) CIRCUIT AND METHOD FOR DRIVING ORGANIC LIGHT-EMITTING DIODE

(75) Inventors: Jin Jang, Seoul (KR); Jae-Won Choi, Seoul (KR)

(73) Assignee: Silicon Display Technology Co., Ltd., Seoul (KR)

( * ) Notice: Subject to any disclaimer, the term of this patent is extended or adjusted under 35 U.S.C. 154(b) by 1301 days.

(21) Appl. No.: 11/396,932

(22) Filed: Apr. 3, 2006

(65) Prior Publication Data

US 2006/0232521 A1 Oct. 19, 2006

(30) Foreign Application Priority Data

Apr. 11, 2005 (KR) ..... 10-2005-0030050

(51) Int. Cl.
*G09G 3/32* (2006.01)

(52) U.S. Cl. ..... 345/82

(58) Field of Classification Search ..... 345/76–83; 315/169.3

See application file for complete search history.

(56) References Cited

U.S. PATENT DOCUMENTS 6,525,704 B1 * 2/2003 Kondo et al. ..... 345/78
6,982,687 B2 * 1/2006 Kim et al. ..... 345/76
2001/0019327 A1 * 9/2001 Kim et al. ..... 345/204
2002/0186188 A1 * 12/2002 Cok ..... 345/82
2004/0056257 A1 * 3/2004 Sakamoto et al. ..... 257/79
2005/0017934 A1 * 1/2005 Chung et al. ..... 345/82

FOREIGN PATENT DOCUMENTS

JP 2003-076327 3/2003

OTHER PUBLICATIONS

Jang; "Organic Light Emitting Diode Dlsplay Device and a Driving Method Thereof" U.S. Appl. No. 11/396,925, filed Apr. 3, 2006.
Jang; "Unevenness Detecting Apparatus for Compensating for Threshold Voltage and Method Thereof" U.S. Appl. No. 11/396,951, filed Apr. 3, 2006.

* cited by examiner

*Primary Examiner*—Chanh Nguyen
*Assistant Examiner*—Robert M Stone
(74) *Attorney, Agent, or Firm*—Ladas & Parry LLP

(57) ABSTRACT

Disclosed are driving circuit and method which are used in an Organic Light Emitting Diode (OLED), and more specifically to a driving circuit of an organic light emitting diode and a driving method thereof which use a thin film transistor (TFT) as an active device. The driving circuit and method can uniformly produce luminance of the light emitting element because the driving current is produced by compensating the unevenness of threshold voltage of the active device. Further, the variance of the threshold voltage $V_{th}$ due to deterioration of the transistor produced according as the driving circuit of the OLED is utilized for a long time is also compensated, thereby increasing life of the display device which applies the driving circuit of the OLED.

3 Claims, 3 Drawing Sheets

CIRCUIT AND METHOD FOR DRIVING ORGANIC LIGHT-EMITTING DIODE

CLAIM FOR PRIORITY

This application claims priority to Korean Patent Application No. 10-2005-0030050 filed on Apr. 11, 2005, in the Korean Intellectual Property Office (KIPO), the entire contents of which are hereby incorporated by reference.

BACKGROUND

1. Field of the Invention

Example embodiments of the present invention relates in general to the field of a driving circuit and method which are used in an Organic Light Emitting Diode (OLED), and more specifically to a driving circuit of an organic light emitting diode and a driving method thereof which can use a thin film transistor (TFT) as an active device.

2. Description of the Related Art

An Organic Light Emitting Diode (hereafter referred to an OLED) display device is a self-light emitting display device which displays images by electrically exciting a luminescent organic component to emit light, and has an advantage of a low driving voltage, a thin-film, and the like. A Liquid Crystal Display (hereafter referred to a LCD) device has a viewing angle restriction, a long response time, and the like. However, the OLED display device is provided with features such as a wide viewing angle, a quick responding speed and the like. Accordingly, the OLED display device has been noticed as a next generation display.

Hereinafter, an operation principal of the display device using the OLED will be explained.

When power is supplied, electrons move and a current begins to flow. The electrons (−) from a cathode move toward an emitting layer by help of an electron-transfer layer, while holes (+: state of electrons released) from the anode move toward the emitting layer by help of a hole-transfer layer. The electrons and holes converged at the emitting layer of an organic material generate an exciton having higher energy state, and simultaneously create light when the exciton is fallen down to a lower energy state. A color of light varies according to what kind of the organic material the emitting layer is composed. A full color may be realized by each organic material emitting R, G, B colors. Contrary to the LCD with a simple function of open/closing pixels, the OLED utilizes self light-emitting organic materials.

Presently, the OLED display device as a thin-film type display device can apply a Passive Matrix (PM) driving method and hence an Active Matrix (AM) driving method, in the same method as the LCD in which has been used widely and commercially. The passive matrix driving method can have a simple structure and apply data exactly to each of the pixels. However, the passive matrix driving method is difficult to be applied to a large screen and a high-precision display. Accordingly, the development of the active matrix driving method has been actively proceeding.

A driving circuit of the OLED will be now explained with reference to FIGS. 1 and 2 according to a conventional active matrix driving method.

FIG. 1 is a schematic diagram illustrating the driving circuit of the OLED having a pixel circuit according to a conventional active matrix method.

Referring to FIG. 1, in the driving circuit of the OLED, a plurality of scan lines ($X_1, X_2, X_3, \ldots, X_n$) for selecting and unselecting the pixels 80 for a desired scan cycle (e.g., a frame period according to a NTSC standard) and a plurality of data lines ($Y_1, Y_2, Y_3, \ldots, Y_n$) for supplying luminance information so as to drive the pixels 80 are arranged in a matrix type. The pixels 80 are arranged in each intersection portion in which the scan lines and the data lines are arranged in the matrix type. The respective pixels 80 are composed of a pixel circuit.

The scan lines ($X_1, X_2, X_3, \ldots, X_n$) are connected to a scan line driving circuit 20, and the data lines ($Y_1, Y_2, Y_3, \ldots, Y_n$) are connected to a data line driving circuit 10. A desired image can be represented by selecting sequentially the scan lines ($X_1, X_2, X_3, \ldots, X_n$) by the data line driving circuit 10, supplying a voltage (or current) of the luminance information from the data lines ($Y_1, Y_2, Y_3, \ldots, Y_n$) by the data line driving circuit 10, and filling repeatedly the voltage of the luminance information. In this case, the driving circuit of the passive matrix type OLED emits light only while light-emitting elements included in the respective pixels 80 are being selected, while the driving circuit of the active matrix type OLED continuously performs the light emission of the light-emitting elements even after the voltage (or current) supply of the luminance information is finished.

Thus, in the large screen and high-precision display, the active matrix type OLED is more superior to the passive matrix type OLED because the driving current level of the light-emitting element is low.

Hereinafter, a driving operation of the driving circuit of the OLED having the plurality of pixels 80 will be explained.

First, the scan line driving circuit 20 selects one of the scan lines ($X_1, X_2, X_3, \ldots, X_n$) and transmits a selecting signal. In the data line driving circuit 10, the data of the luminance information is transmitted to pixels arranged in transverse direction via the data lines ($Y_1, Y_2, Y_3, \ldots, Y_n$). Then, the scan line driving circuit 20 transmits an unselected signal to the selected scan line, and then selects the next scan line ($X_{N+1}$) so as to transmit the selected scan line signal. If the selection signal and the unselected signal are sequentially transmitted to the scan line, the driving circuit of the OLED can obtain a desired display by transmitting repeatedly the data.

FIG. 2 is a circuit diagram illustrating a typical pixel which is included in a driving circuit of an OLED according to an active matrix method.

Referring to FIG. 2, a pixel circuit for driving a pixel 80 includes two NMOS transistors T1 and T2, i.e., a first and a second active element, a capacitor $C_{ST}$, and an OLED. A gate terminal of the NMOS transistor T1 is connected to a scan line $X_N$, a drain terminal thereof is connected to a data line $Y_M$, and a source terminal thereof is connected to the gate terminal of the NMOS transistor T2 and the capacitor $C_{ST}$. A source of the NMOS transistor T2 is connected to a positive pole (i.e., anode), and a drain terminal thereof is connected to a positive power source ($V_{DD}$).

A cathode of the OLED is connected to a negative supply source ($V_{SS}$). Thus, a current of the OLED is controlled by applying a voltage of the data line $Y_m$ to the gate terminal of the NMOS transistor T2 via the NMOS transistor T1.

Hereinafter, a driving operation of the pixel circuit will be explained.

When the gate terminal of the NMOS transistor T1 receives a selection signal from the scan line $X_N$, the NMOS transistor T1 is turned on. At this time, a voltage corresponding to luminance information, which is applied to the data line $Y_M$ by the data line driving circuit, is transmitted to the gate terminal of the NMOS transistor T2 via the NMOS transistor T1, and the luminance information voltage is stored in the capacitor $C_{ST}$. Even while the NMOS transistor T1 is turned off by receiving the unselected signal supplied from the scan line $X_N$over one frame period, the voltage of the gate terminal of the NMOS transistor T2 is constantly maintained by the capacitor $C_{ST}$ and thus the current flowing to the OLED via the NMOS transistor T2 is constantly maintained.

As such, in conventional pixel circuit, since the current flowing to the OLED is the same as the current flowing from the drain terminal of the NMOS transistor T2 to the source terminal, the current is controlled by the voltage of the gate terminal of the NMOS transistor T1, but is different from the magnitude of a desired current due to unevenness of an electrical characteristic or a characteristic deterioration of the NMOS transistor T2.

The thin film transistor used in the display device is an active element suitable for the large screen and high precision display. However, even though the thin film transistor is formed on the same substrate, there is a problem that a threshold voltage of the thin film transistor frequently has a voltage deviation of several hundreds of mV or more than 1 Volt.

For example, even though a same signal potential is supplied to the gate of the thin film transistor in different pixels, when the threshold voltage of the transistor included in each pixel is different, the current value flowing to the OLED deviates greatly from a value necessary for each pixel, and thus the high quality of the image necessary for the display device can not be obtained. The threshold voltage can not avoid some degree of variation according to a manufacturing company or products.

The respective products are necessary to determine how the data line potential is established for the driving current to be flown to the OLED according to parameter. However, it is difficult to be realistic in a manufacturing process of the display device.

Additionally, the driving current is greatly varied at an initial value of the threshold voltage due to the characteristic deterioration caused by a environment temperature and an usage for a long time. In this case, the definition or brightness of the display is greatly varied, thereby decreasing rapidly life of the display device.

SUMMARY

Accordingly, the present invention is provided to substantially obviate one or more problems due to limitations and disadvantages of the related art.

Example embodiments of the present invention provide a driving circuit of an OLED which can apply a driving current to the OLED without being affected by a variation of a threshold voltage of a transistor used in an active matrix, and a method which can display an image having high quality using the driving circuit.

In some example embodiments, a driving circuit of an OLED includes a scan line driving circuit configured to apply sequentially a selecting signal or an unselecting signal to a plurality of scan lines; a data line driving circuit configured to apply a voltage corresponding to image information to a plurality of data lines; and a pixel circuit arranged in each point where the scan lines and the data lines are intersected. The pixel circuit includes: a first transistor of which a gate terminal is connected to $(N-1)^{th}$ scan line $X_{N-1}$, and a drain terminal is connected to a power supply voltage $V_{DD}$; a second transistor of which a drain terminal is connected to the source terminal of the first transistor, and a gate terminal is connected to a $N^{th}$ scan line $X_N$; a third transistor of which a drain terminal is connected to the source terminal of the second transistor, and a gate terminal is connected to the source terminal of the first transistor and the drain terminal of the second transistor; a fourth transistor of which a gate terminal is connected to a $N^{th}$ scan line $X_N$, a drain terminal is connected to the data line $Y_M$, and a source terminal is connected to the source terminal of the third transistor; a fifth transistor of which a drain terminal is connected to the source terminals of the third and fourth transistor, and a gate terminal is connected to a $(N+1)^{th}$ scan line $X_{N+1}$; a sixth transistor of which a drain terminal is connected to the power supply voltage $V_{DD}$, a gate terminal is connected to the source terminal of the first transistor, the drain terminal of the second transistor, and the gate terminal of the third transistor, and a source terminal is connected to the source terminal of the fifth transistor; a capacitor of which one terminal is connected to the drain terminal of the sixth transistor and the power supply voltage $V_{DD}$, and the other terminal is connected to the source terminal of the first transistor, the drain terminal of the second transistor, the gate terminal of the third transistor and the gate terminal of the sixth transistor; and an OLED of which an anode terminal is connected to the sources of the fifth and sixth transistor.

The $(N-1)^{th}$ scan line, the $N^{th}$ scan line and the $(N+l)^{th}$ scan line are sequentially selected.

In other example embodiments, a driving method of an OLED using a driving circuit of an OLED including a scan line driving circuit configured to apply sequentially a selecting signal or an unselecting signal to a plurality of scan lines; a data line driving circuit configured to apply a voltage corresponding to image information to a plurality of data lines; and a pixel circuit arranged in each point where the scan lines and the data lines are intersected, includes: charging a pre-charging voltage to a gate terminal of a third and sixth transistor by a current applied from a power supply voltage $V_{DD}$, when a first transistor is only turned on by selecting a $(N-1)^{th}$ scan line $X_{N-1}$; storing a image information voltage $V_{data}+V_{th}$ which adds a voltage $V_{data}$ corresponding to image information transmitted to a capacitor $C_{ST}$ via a data line $Y_M$ to a threshold voltage $V_{th}$, i.e., for which the threshold voltage is compensated, when a second and fourth transistor is only turned on by unselecting the $(N-1)^{th}$ scan line $(X_{N-1})$ and selecting a $N^{th}$ scan line $X_N$; and supplying a current flowing to the OLED, when a fifth transistor is turned on by unselecting the $N^{th}$ scan line $X_N$ and selecting a (N+1) scan line $X_{N+1}$, and a sixth transistor is turned on by the image information voltage for which the threshold voltage stored in the capacitor $C_{ST}$ is compensated.

The step of storing the image information voltage $V_{data}+V_{th}$, for which the threshold voltage $V_{th}$ is compensated, to the capacitor $C_{ST}$ may include: transmitting the voltage $V_{data}$ corresponding to image information, which is applied from the data line $Y_M$ connected to the drain terminal of the fourth transistor, to the source terminal of the third transistor via the fourth transistor; and discharging the pre-charging voltage $V_{precharging}$ charged to the gate terminals of the third and sixth transistor via the second, third and fourth transistor.

The threshold voltage $V_{th}$ may be a voltage between the gate terminal and the source terminal of the third transistor of which the source terminal is connected to the source terminal of the fourth transistor, and the gate terminal is connected to the terminal opposite to one terminal of the capacitor connected to the power supply voltage $V_{DD}$, when the voltage flowing to the third transistor is 1 nA to 10 nA.

In still other example embodiments, a driving circuit of an OLED includes a scan line driving circuit configured to apply sequentially a selecting signal or an unselecting signal to a plurality of scan lines; a data line driving circuit configured to apply a voltage corresponding to image information to a plurality of data lines; and a pixel circuit arranged in each point where the scan lines and the data lines are intersected. The pixel circuit includes: a first transistor of which a gate terminal is connected to $(N-1)^{th}$ scan line $X_{N-1}$, and a drain terminal is connected to a power supply voltage $V_{DD}$; a second transistor of which a drain terminal is connected to the source terminal of the first transistor, and a gate terminal is connected to a $N^{th}$ scan line $X_N$; a third transistor of which a drain terminal is connected to the source terminal of the second transistor, and a gate terminal is connected to the source terminal of the first transistor and the drain terminal of the second transistor; a fourth transistor of which a gate terminal is connected to a $N^{th}$ scan line $X_N$, a drain terminal is connected to the data line $Y_M$, and a source terminal is connected to the source terminal of the third transistor; a fifth transistor of which a drain terminal is connected to the power supply voltage $V_{DD}$, and a gate terminal is connected to the source terminal of the first transistor, the drain terminal of the second transistor and the gate terminal of the third transistor; a sixth transistor of which a drain terminal is connected to sources of the third, fourth and fifth transistor, and a gate terminal is connected to a $N^{th}$ light-emitting control scan line $ECL_N$; a capacitor $C_{ST}$ of which one terminal is connected to the drain terminal of the fifth transistor and the power supply voltage $V_{DD}$, and the other terminal is connected to the source terminal of the first transistor, the drain terminal of the second transistor, the gate terminal of the third transistor and the gate terminal of the fifth transistor; and an OLED of which an anode terminal is connected to the source terminal of the sixth transistor.

The $(N-1)^{th}$ scan line and the $N^{th}$ scan line may be sequentially selected, the $N^{th}$ light-emitting control scan line $ECL_N$ may be unselected while the $(N-1)^{th}$ scan line and the $N^{th}$ scan line are selected, and the sixth transistor may be turned on for a time except that the $(N-1)^{th}$ scan line and the $N^{th}$ scan line are selected In still other example embodiments, a driving method of an OLED using a driving circuit of an OLED including a scan line driving circuit configured to apply sequentially a selecting signal or an unselecting signal to a plurality of scan lines; a data line driving circuit configured to apply a voltage corresponding to image information to a plurality of data lines; and a pixel circuit arranged in each point where the scan lines and the data lines are intersected, includes: charging a pre-charging voltage $V_{precharging}$ to a gate terminal of a third and fifth transistor by a current applied from a power supply voltage $V_{DD}$, when a first transistor is only turned on by selecting a $(N-1)^{th}$ scan line $X_{N-1}$; storing a image information voltage $V_{data}+V_{th}$ which adds a voltage $V_{data}$ corresponding to image information transmitted to a capacitor $C_{ST}$ via a data line $Y_M$ to a threshold voltage $V_{th}$, i.e., for which the threshold voltage is compensated, when a second and fourth transistor is only turned on by unselecting the $(N-1)^{th}$ scan line $(X_{N-1})$ and selecting a $N^{th}$ scan line $X_N$; and supplying a current flowing to the OLED, when a sixth transistor is turned on by unselecting the $N^{th}$ scan line $X_N$ and selecting a $N^{th}$ light-emitting control scan line $ECL_N$, and a fifth transistor is turned on by the image information voltage for which the threshold voltage stored in the capacitor $C_{ST}$ is compensated.

The step of storing the image information voltage $V_{data}+V_{th}$, for which the threshold voltage $V_{th}$ is compensated, in the capacitor $C_{ST}$ may include: transmitting the voltage $V_{data}$ corresponding to image information applied from the data line $Y_M$, which is connected to the drain terminal of the fourth transistor, to the source terminal of the third transistor via the fourth transistor; and discharging the pre-charging voltage $V_{precharging}$ charged to the gate terminals of the third and fifth transistor via the second, third and fourth transistor.

The threshold voltage $V_{th}$ may be a voltage between the gate terminal and the source terminal of the third transistor of which the source terminal is connected to the source terminal of the fourth transistor, and the gate terminal is connected to the terminal opposite to one terminal of the capacitor connected to the power supply voltage $V_{DD}$, when the voltage flowing to the third transistor is 1 nA to 10 nA.

BRIEF DESCRIPTION OF THE DRAWINGS

Example embodiments of the present invention will become more apparent by describing in detail example embodiments of the present invention with reference to the accompanying drawings, in which.

DESCRIPTION OF EXAMPLE EMBODIMENTS OF THE PRESENT INVENTION

Figure 1:
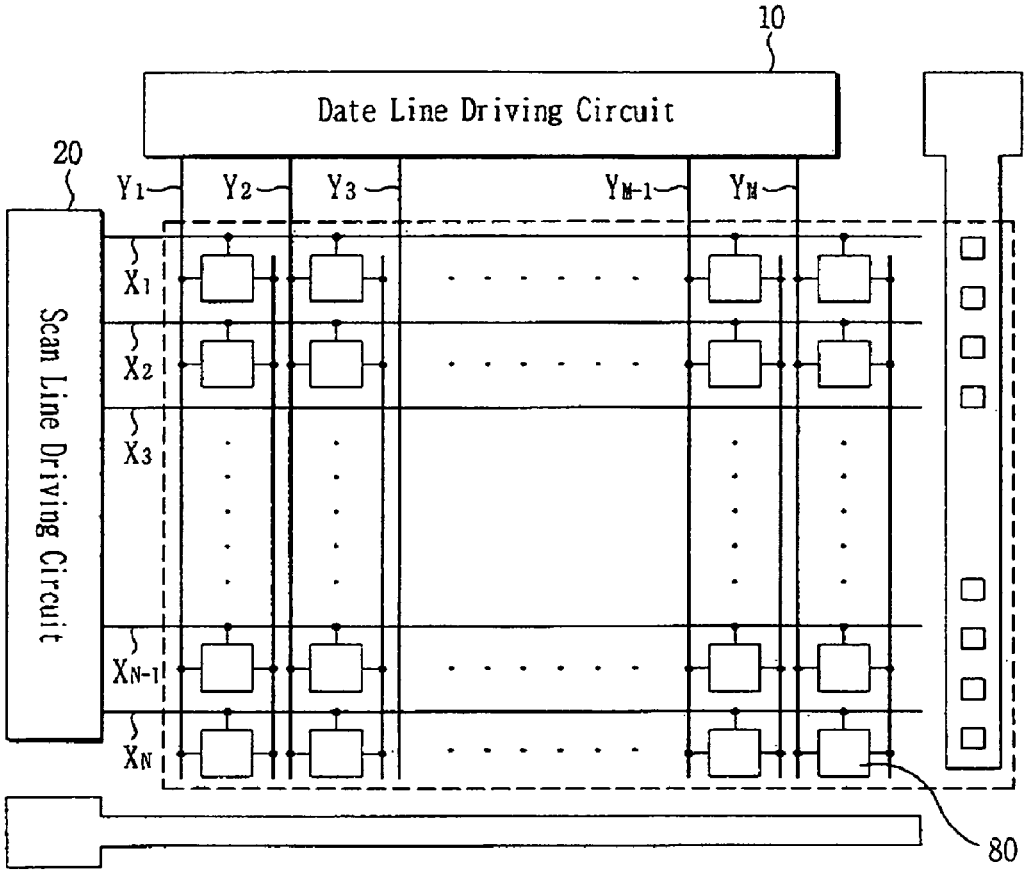
FIG.1 PRIOR ART
FIG. 1 is a schematic diagram illustrating a driving circuit of an OLED having a pixel circuit according to a conventional active matrix method.
Figure 2:
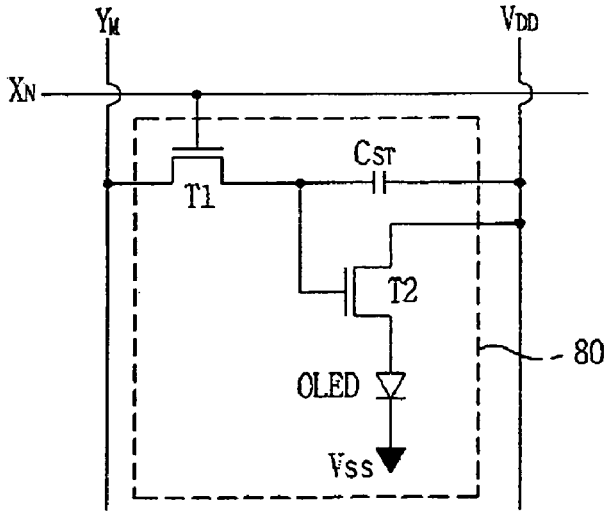
FIG.2 PRIOR ART
FIG. 2 is a circuit diagram illustrating a conventional pixel circuit which is included in a driving circuit of the OLED according to an active matrix method.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

Hereinafter, preferred embodiments of the present invention will be described in detail with reference to the accompanying drawings. The embodiment will be explained in detail for enabling people who have common intellects in a corresponding field to execute the present invention.

EXAMPLE 1

Figure 3A:
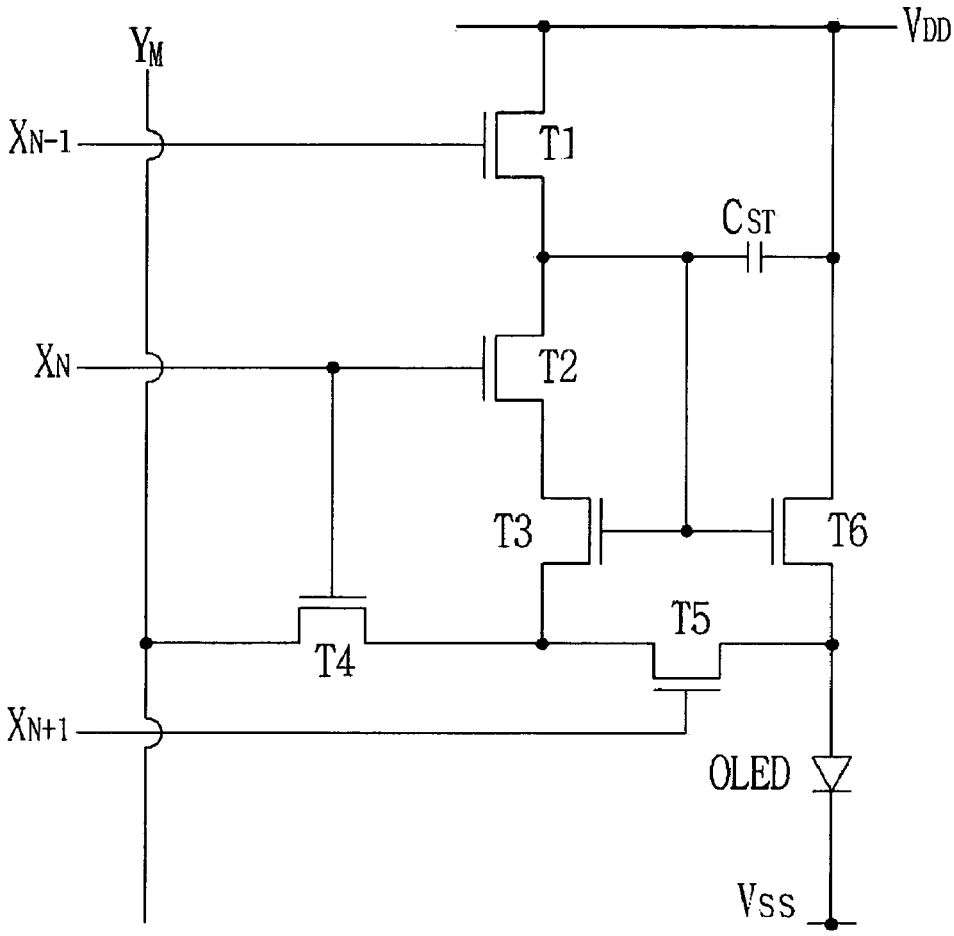
FIGS. 3A and 3B show waveforms of explaining a pixel circuit which is included in a driving circuit of the OLED and a driving of the pixel circuit according to one example embodiment of the present invention.
Figure 3B:
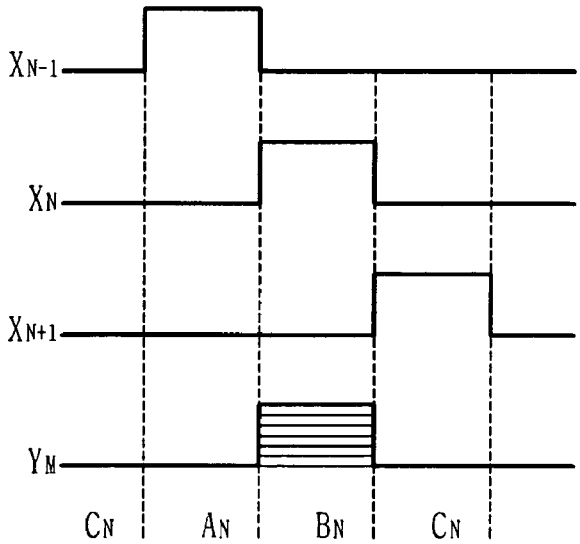

FIG. 3A is a circuit diagram illustrating a pixel circuit which is included in a driving circuit of an OLED, and FIG. 3B shows waveform of explaining the pixel circuit according to one example embodiment of the present invention.

According to the example embodiment of the present invention, a driving circuit of an active matrix type OLED enables a voltage filling type of a pixel circuit for filling image information by a voltage to be arranged in a matrix type, similar to the driving circuit of a general OLED.

The respective pixel circuit may include a scan line driving circuit for transmitting a selecting signal and an unselecting signal to a plurality of scan lines, a data line driving circuit for applying a data voltage to the plurality of data lines, an OLED which is arranged in each intersection that the scan lines and the data lines are intersected and which emits light by a driving current, and a plurality of transistors for applying a desired current to the OLED.

As shown in FIG. 3A, the pixel circuit included in the driving circuit of the OLED is composed of five switching transistors T1, T2, T3, T4 and T5, a driving transistor T6, a capacitor $C_{ST}$, and an OLED. In a display device which the plurality of pixel circuits are arranged in a matrix type, the pixel circuit shown in FIG. 3A is the pixel circuit which is arranged in $M^{th}$ column of $N^{th}$ row in the matrix.

The pixel circuit is driven by three scan lines $X_{N-1}$, $X_N$ and $X_{N+1}$, one data line $Y_M$, and a power supply voltage $V_{DD}$. The three scan lines $X_{N-1}$, $X_N$ and $X_{N+1}$ are sequentially selected. Accordingly, some switching transistors T1, T2, T4 and T5 of the switching transistors T1, T2, T3, T4 and T5 perform sequentially a switching operation by the sequentially selected scan lines.

A first $(N-1)^{th}$ scan line $X_{N-1}$ of the three scan lines $X_{N-1}$, $X_N$ and $X_{N+1}$ is connected to a gate terminal of the first transistor T1. Thus, the first transistor T1 is turned on according as the (N−1)th scan line $X_{N-1}$ is selected by the selecting signal of the scan line driving circuit, and thus the current flows from its drain terminal to its source terminal.

The drain terminal of the first transistor T1 is connected to the power supply voltage $V_{DD}$, and its source terminal is connected to a drain terminal of the second transistor T2.

A gate terminal of the second transistor T2, to which the source and the drain terminal of the first transistor T1 are connected, is connected to a second $N^{th}$ scan line $X_N$ of the three scan lines $X_{N-1}$, $X_N$ and $X_{N+1}$. Thus, the second transistor T2 is turned on according as the $N^{th}$ scan line $X_N$ is selected by the selecting signal of the scan line driving circuit, and thus the current flows from its drain terminal to its source terminal. Additionally, the source terminal of the second transistor T2 is connected to the drain terminal of the third transistor T3.

A gate of the third transistor T3, to which the source terminal and the drain terminal of the second transistor T2 are connected, is connected to the source terminal of the first transistor T1 and the drain of the second transistor T2. A source of the third transistor T3 is connected with a source of a fourth transistor T4 and a drain of a fifth transistor T5.

A gate terminal of the fourth transistor T4, of which a source terminal is connected with the source terminal of the third transistor T3, is connected to a second $N^{th}$ scan line $X_N$ of the three scan lines $X_{N-1}$, $X_N$ and $X_{N+1}$. Thus, the fourth transistor T4 is turned on according as the $N^{th}$ scan line $X_N$ is selected by the selecting signal of the scan line driving circuit, and thus the current flows from its drain terminal to its source terminal.

A drain terminal of the fourth transistor T4 is connected to the data line $Y_M$ which applies a voltage $V_{data}$ corresponding to the image information. Thus, when the fourth transistor T4 is turned on by selecting the $N^{th}$ scan line, the voltage $V_{data}$ corresponding to the image information is transmitted to the source terminal of the third transistor T3 via the fourth transistor T4. A gate terminal of the fifth transistor T5, to which the source terminal and the drain terminal of the third transistor T3 are connected, is connected to a third $(N+1)^{th}$ scan line $X_{N+1}$ of the three scan lines $X_{N-1}$, $X_N$ and $X_{N+1}$. Thus, the fifth transistor T5 is turned on according as the $(N+1)^{th}$ scan line $X_{N+1}$ is selected by the selecting signal of the scan line driving circuit, and thus the current flows from its drain terminal to its source terminal.

Additionally, the drain terminal of the fifth transistor T5 is connected with the source terminal of the third transistor T3 as well as the source terminal of the fourth transistor T4. The source terminal of the fifth transistor T5 is connected to a source terminal of a sixth transistor T6 as well as an anode terminal of the OLED.

A gate terminal of the sixth transistor T6 of which a source terminal is connected to the source of the fifth transistor T5 is connected to the source terminal of the first transistor T1, the drain terminal of the second transistor T2, and the gate terminal of the third transistor T3. A drain terminal of the sixth transistor T6 is connected to the power supply voltage $V_{DD}$ and one terminal of the capacitor $C_{ST}$.

The other terminal of the capacitor $C_{ST}$, of which the one terminal is connected to the drain terminal of the sixth transistor T6, is connected to the source terminal of the first transistor T1, the drain terminal of the second transistor T2, and the gate terminals of the third and sixth transistor T3 and T6. The one terminal of the capacitor $C_{ST}$ is connected to the drain terminal of the sixth transistor T6 as well as the power supply voltage $V_{DD}$.

In order to supply a driving current of the OLED, the source of the sixth transistor T6 is connected to the anode terminal of the OLED. Additionally, a cathode terminal of the OLED is connected to a negative voltage source $V_{SS}$ or a ground.

A driving operation of the OLED according to the above-described pixel circuit will be now explained.

First, the first transistor T1 is turned on by selecting $(N-1)^{th}$ scan line ($X_{N-1}$) by the scan line driving circuit. Since the switching transistor T2, T3, T4 and T5 are turned off even in the case that the first transistor T1 is turned on, a closed circuit is not performed through the switching transistor T2, T3, T4 and T5.

When the first transistor T1 is turned on, a current flowing from the power supply voltage $V_{DD}$ is applied to the gate terminals of the third and sixth transistors T3 and T6, and the pre-charging voltage $V_{precharging}$ is charged to the gate terminals of the third and sixth transistor T3 and T6.

As described above, a process for charging the pre-charging voltage to the gate terminals of the third and sixth transistor T3 and T6 are performed while the $(N-1)^{th}$ scan line ($X_{N-1}$) is an ON pulse according to the selecting signal of the scan line driving circuit as described in FIG. 3B.

After the pre-charging voltage is charged to the gate terminals of the third and sixth transistor T3 and T6 by selecting the $(N-1)^{th}$ scan line ($X_{N-1}$), the $(N-1)^{th}$ scan line ($X_{N-1}$) is unselected and the $N^{th}$ scan line $X_N$ is selected, by the scan line driving circuit as described in FIG. 3B. Additionally, the voltage is also applied to the drain terminal of the fourth transistor T4 according as the data line $Y_M$ is turned on.

When the $(N-1)^{th}$ scan line ($X_{N-1}$) is not selected, the first transistor T1 is turned off, and when the $N^{th}$ scan line $X_N$ is selected, the second transistor T2 and the fourth transistor T4 are turned on. When the $N^{th}$ scan line $X_N$ is the ON pulse ($B_N$ of FIG. 3B), the fourth transistor T4 passes through the voltage $V_{data}$ corresponding to the image information which is transmitted from the data line $Y_M$. Finally, the image information voltage $V_{data}+V_{th}$, which adds the voltage $V_{data}$ corresponding to the image information which is transmitted from the data line $Y_M$ to the capacitor $C_{ST}$ to a threshold voltage $V_{th}$, is stored. The image information voltage $V_{data}+V_{th}$ is to compensate the threshold voltage $V_{th}$.

Concretely, when the fourth transistor T4 is turned on according as the $N^{th}$ scan line $X_N$ is selected, the voltage $V_{data}$ corresponding to the image information applied from the data line $Y_M$, which is connected to the drain terminal of the fourth transistor T4, is transmitted to the source terminal of the third transistor T3 via the fourth transistor T4. The pre-charging voltage $V_{precharging}$ that is charged to the gate terminals of the third and sixth transistor T3 and T6 is discharged through the second transistor T2, the third transistor T3 and the fourth transistor T4.

Then, the image information voltage $V_{data}+V_{th}$, which adds the voltage $V_{data}$ corresponding to the image information which is transmitted via the data line $Y_M$ to the threshold voltage $V_{th}$, is stored in the capacitor $C_{ST}$. The threshold voltage $V_{th}$ is a voltage between the gate terminal and the source terminal of the third transistor of which the source terminal is connected to the source terminal of the fourth transistor, and the gate terminal is connected to the terminal opposite to one terminal of the capacitor connected to the power supply voltage $V_{DD}$. At this time, the current flowing to the third transistor is 1 □ to 10 □.

After the image information voltage $V_{data}+V_{th}$, which the threshold voltage is compensated, is stored, the $N^{th}$ scan line $X_N$ and the data line $Y_M$ are not selected, and the $(N+1)^{th}$ scan line ($X_{N+1}$) is selected for a desired time ($C_N$ of FIG. 3B).

As describe above, when the $N^{th}$ scan line $X_N$ is not selected, the second transistor T2 and the fourth transistor T4 are turned off. When the $(N+1)^{th}$ scan line ($X_{N+1}$) is selected, the fifth transistor T5 is only turned on. The sixth transistor T6 for applying the current to the OLED is turned on, according as the image information voltage $V_{data}+V_{th}$ stored in the capacitor $C_{ST}$ is applied to the gate terminal of the sixth transistor T6. Accordingly, the OLED is illuminated by the current applied from the sixth transistor T6.

Meanwhile, when the fifth transistor T5 is turned on, the sources of the third transistor T3 and the sixth transistor T6 are connected to each other. Thus, a voltage across the source of the third transistor T3 and the sixth transistor T6 is the same, and is submitted under same positive gate bias stress.

A typical amorphous silicon thin film transistor has a characteristic that the threshold voltage is increased under the positive gate bias stress. As described above, a meaning that the third transistor and the sixth transistor are submitted under same positive gate bias stress is to have same deterioration characteristic.

According to the present invention, the third transistor T3 and the sixth transistor T6 are arranged in adjacent position with each other so that their source terminals have same voltage. Thus, the third transistor T3 and the sixth transistor T6 have same deterioration characteristic. The threshold of the third transistor T3 and the sixth transistor T6 can be equally shifted. As a result, the voltage across the gate terminal of the sixth transistor T6 becomes the voltage the image information voltage for which the threshold voltage is compensated, thereby being capable of applying the current to the OLED.

EXAMPLE 2

Figure 4A:
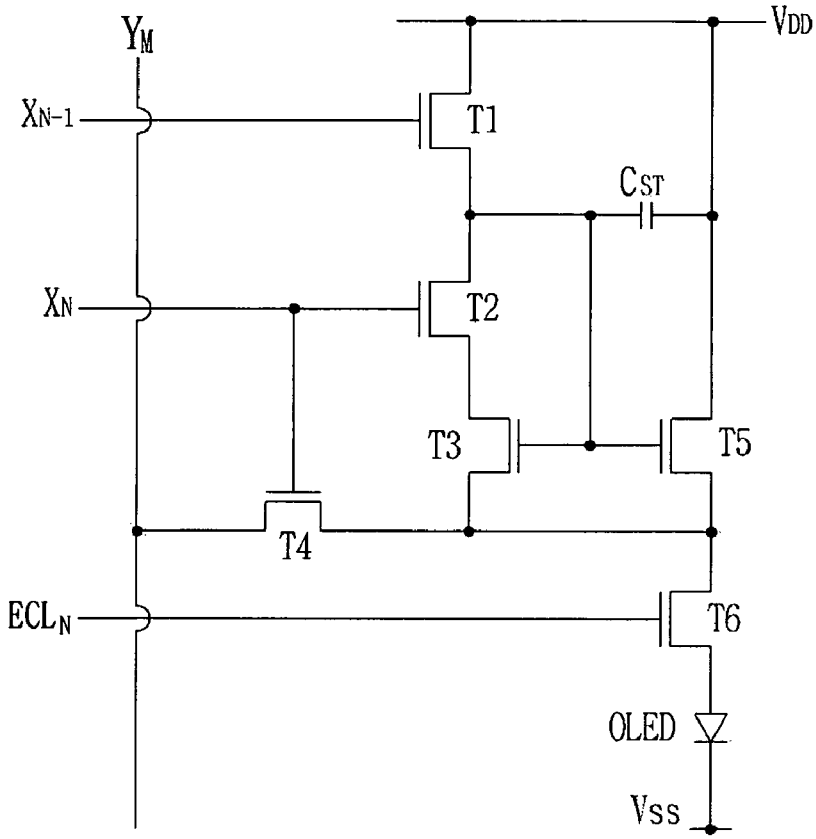
FIGS. 4A and 4B show waveforms of explaining a pixel circuit which is include in the driving circuit of the OLED and a driving of the pixel circuit according to another example embodiment of the present invention.
Figure 4B:
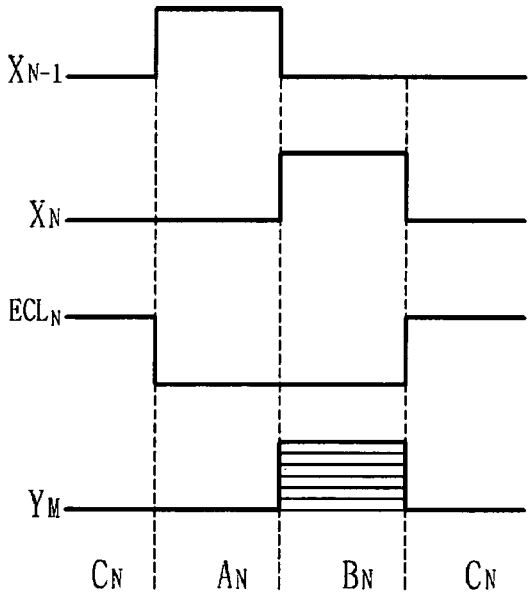

FIG. 4A shows a pixel circuit which is included in the driving circuit of the OLED according to another example embodiment of the present invention, and FIG. 4B shows waveform for explaining the pixel circuit.

According to the embodiment of the present invention, a driving circuit of an active matrix type OLED enables a voltage filling type of a pixel circuit for filling image information by a voltage to be arranged in a matrix type, similar to the driving circuit of a general OLED.

The respective pixel circuit may include a scan line driving circuit for transmitting a selecting signal and an unselecting signal to a plurality of scan lines, a data line driving circuit for applying a data voltage to the plurality of data lines, an OLED which is arranged in each intersection that the scan lines and the data lines are intersected and which emits light by a driving current, and a plurality of transistors for applying a desired current to the OLED.

As shown in FIG. 4A, the pixel circuit included in the driving circuit of the OLED is composed of five switching transistors T1, T2, T3, T4 and T6, a driving transistor T5, a capacitor $C_{ST}$, and an OLED. In a display device which the plurality of pixel circuits are arranged in a matrix type, the pixel circuit shown in FIG. 4A is the pixel circuit which is arranged in $M^{th}$ column of $N^{th}$ row in the matrix. The pixel circuit of the example 2 embodiment is similar to that of the example 1 embodiment, except that an arrangement of the switching transistor is different and the driving waveform is different from each other.

The pixel circuit is driven by three scan lines $X_{N+1}$, $X_N$ and $ECL_N$, one data line $Y_M$, and a power supply voltage $V_{DD}$. The two scan lines $X_{N-1}$ and $X_N$ are sequentially selected, and a light-emitting control scan line $ECL_N$ is selected by the same method as FIG. 4B. Accordingly, some switching transistors T1, T2, and T4 of the switching transistors T1, T2, T3, T4 and T6 perform sequentially a switching operation by the sequentially selected scan lines $X_{N-1}$ and $X_N$. Additionally, the switching transistor T6 performs the switching operation by light-emitting control scan line $ECL_N$.

A first $(N-1)^{th}$ scan line $X_{N-1}$ of the three scan lines $X_{N-1}$, $X_N$ and $ECL_N$ is connected to a gate terminal of the first transistor T1. Thus, the first transistor T1 is turned on according as the $(N-1)^{th}$ scan line $X_{N-1}$ is selected by the selecting signal of the scan line driving circuit, and thus the current flows from its drain terminal to its source terminal. In this time, the $N^{th}$ light-emitting control scan line $ECL_N$ is not selected and the sixth transistor T6 is turned off, thereby preventing the current from being flown to the OLED.

The drain terminal of the first transistor T1 is connected to the power supply voltage $V_{DD}$, and its source terminal is connected to a drain terminal of the second transistor T2.

A gate terminal of the second transistor T2, to which the source and the drain terminal of the first transistor T1 are connected, is connected to a second $N^{th}$ scan line $X_N$ of the three scan lines $X_{N-1}$, $X_N$ and $ECL_N$ Thus, the second transistor T2 is turned on according as the $N^{th}$ scan line $X_N$ is selected by the selecting signal of the scan line driving circuit, and thus the current flows from its drain terminal to its source terminal. Additionally, the source terminal of the second transistor T2 is connected to the drain terminal of the third transistor T3.

A gate terminal of the third transistor T3, to which the source terminal and the drain terminal of the second transistor T2 are connected, is connected to the source terminal of the first transistor T1 and the drain terminal of the second transistor T2. A source terminal of the third transistor T3 is connected to a source terminal of a fourth transistor T4, a source terminal of a fifth transistor T5, and a drain terminal of a sixth transistor T6.

A gate terminal of the fourth transistor T4, of which a source terminal is connected with the source terminal of the third transistor T3, is connected to a second $N^{th}$ scan line $X_N$ of the three scan lines $X_{N-1}$, $X_N$ and $ECL_N$ Thus, the fourth transistor T4 is turned on according as the $N^{th}$ scan line $X_N$ is selected by the selecting signal of the scan line driving circuit, and thus the current flows from its drain terminal to its source terminal.

A drain terminal of the fourth transistor T4 is connected to the data line $Y_M$ which applies a voltage $V_{data}$ corresponding to the image information. Thus, when the fourth transistor T4 is turned on by selecting the $N^{th}$ scan line, the voltage $V_{data}$ corresponding to the image information is transmitted to the source terminal of the third transistor T3 via the fourth transistor T4.

A gate terminal of the fifth transistor T5, of which the source terminal is connected to the source terminals of the third and fourth transistor T3 and T4, is connected to the source terminal of the first transistor T1, the drain terminal of the second transistor T2, and the gate terminal of the third transistor T3. The drain terminal of the fifth transistor T5 is connected to the power supply voltage $V_{DD}$ and one terminal of the capacitor $C_{ST}$.

A gate terminal of the sixth transistor T6, of which the drain terminal is connected to the source terminals of the third transistor T3, is connected to a third $N^{th}$ light-emitting scan line $ECL_N$ of the three scan lines $X_{N-1}$, $X_N$ and $ECL_N$. Thus, the $N^{th}$ light-emitting scan line $ECL_N$ is not selected while the $(N-1)^{th}$ scan line and the $N^{th}$ scan line are selected, and the sixth transistor is turned on for a time except that the $(N-1)^{th}$ scan line and the $N^{th}$ scan line are selected.

The sixth transistor T6 is turned off according as the $N^{th}$ scan line $ECL_N$ is unselected by the unselecting signal of the scan line driving circuit, thereby preventing a current from flowing from its drain terminal to its source terminal.

Additionally, the drain terminal of the sixth transistor T6 is connected with the source terminal of the third transistor T3 as well as the source terminal of the fourth transistor T4. The source terminal of the sixth transistor T6 is connected to an anode terminal of the OLED.

The other terminal of the capacitor $C_{ST}$ of which the one terminal is connected to the drain terminal of the fifth transistor T5 is connected to the source terminal of the first transistor T1, the drain terminal of the second transistor T2, and the gate terminals of the third and fifth transistor T3 and T5. The one terminal of the capacitor $C_{ST}$ is connected to the drain terminal of the fifth transistor T5 as well as the power supply voltage $V_{DD}$.

In order to supply a driving current of the OLED, the source terminal of the sixth transistor T6 is connected to the anode terminal of the OLED. Additionally, a cathode terminal of the OLED is connected to a negative voltage source $V_{SS}$ or a ground.

A driving operation of the OLED according to the above-described pixel circuit according to another example 2 embodiment of the present invention will be now explained.

First, the first transistor T1 is turned on by selecting $(N-1)^{th}$ scan line ($X_{N-1}$) by the scan line driving circuit. Since the switching transistor T2, T3, T4 and T6 are turned off even in the case that the first transistor T1 is turned on, a closed circuit is not performed through the switching transistor T2, T3, T4 and T6.

However, when the first transistor T1 is turned on, a current flowing from the power supply voltage $V_{DD}$ is applied to the gate terminals of the third and fifth transistors T3 and T5, and the pre-charging voltage $V_{precharging}$ is charged to the gate terminals of the third and fifth transistor T3 and T5.

As described above, a process for charging the pre-charging voltage to the gate terminals of the third and fifth transistor T3 and T5 are performed while the $(N-1)^{th}$ scan line ($X_{N-1}$) is an ON pulse (i.e., $A_N$ of FIG. 4B) according to the selecting signal of the scan line driving circuit as described in FIG. 4B.

After the pre-charging voltage is charged to the gate terminals of the third and fifth transistor T3 and T5 by selecting the $(N-1)^{th}$ scan line ($X_{N-1}$), the $(N-1)^{th}$ scan line ($X_{N-1}$) is unselected and the $N^{th}$ scan line $X_N$ is selected, by the scan line driving circuit as described in FIG. 4B. Additionally, the voltage is also applied to the drain terminal of the fourth transistor T4 according as the data line $Y_M$ is turned on.

When the $(N-1)^{th}$ scan line ($X_{N-1}$) is not selected, the first transistor T1 is turned off, and when the $N^{th}$ scan line $X_N$ is selected, the second transistor T2 and the fourth transistor T4 are turned on. When the $N^{th}$ scan line $X_N$ is selected and is the ON pulse ($B_N$ of FIG. 4B), the fourth transistor T4 passes through the voltage $V_{data}$ corresponding to the image information which is transmitted from the data line $Y_M$. Finally, the image information voltage $V_{data}+V_{th}$, which adds the voltage $V_{data}$ corresponding to the image information which is transmitted from the data line $Y_M$ to the capacitor $C_{ST}$ to a threshold voltage $V_{th}$, is stored. The image information voltage $V_{data}+V_{th}$ is to compensate the threshold voltage $V_{th}$.

Concretely, when the fourth transistor T4 is turned on according as the $N^{th}$ scan line $X_N$ is selected, the voltage $V_{data}$ corresponding to the image information applied from the data line $Y_M$ which is connected to the drain terminal of the fourth transistor T4 is transmitted to the source terminal of the third transistor T3 via the fourth transistor T4. The pre-charging voltage $V_{precharging}$ that is charged to the gate terminals of the third and fifth transistor T3 and T5 are discharged through the second transistor T2, the third transistor T3 and the fourth transistor T4.

Then, the image information voltage $V_{data}+V_{th}$, which adds the voltage $V_{data}$ corresponding to the image information which is transmitted via the data line $Y_M$ to the threshold voltage $V_{th}$, is stored in the capacitor $C_{ST}$ . The threshold voltage $V_{th}$ is a voltage between the gate terminal and the source terminal of the third transistor T3 of which the source terminal is connected to the source terminal of the fourth transistor T4, and the gate terminal is connected to the terminal opposite to one terminal of the capacitor connected to the power supply voltage $V_{DD}$. At this time, the current flowing to the third transistor is 1 nA to 10 nA.

After the image information voltage $V_{data}+V_{th}$, which the threshold voltage is compensated, is stored, the $N^{th}$ scan line $X_N$ and the data line $Y_M$ are not selected, and the $N^{th}$ light-emitting scan line $ECL_N$ is selected for a desired time ($C_N$ of FIG. 4B).

As describe above, when the $N^{th}$ scan line $X_N$ is unselected, the second transistor T2 and the fourth transistor T4 are turned off. When the $N^{th}$ light-emitting scan line $ECL_N$ is selected, the sixth transistor T6 is only turned on. The fifth transistor T5 for applying the current to the OLED is turned on, according as the image information voltage $V_{data}+V_{th}$ stored in the capacitor $C_{ST}$ is applied to the gate terminal of the fifth transistor T5. Accordingly, the OLED is illuminated by the current applied from the fifth transistor T5.

Meanwhile, when the sixth transistor T6 is turned on, the sources of the third transistor T3 and the fifth transistor T5 are connected to the drain terminal of the sixth transistor T6 each other. Thus, a voltage across the source of the third transistor T3 and the fifth transistor T5 is the same, and is submitted under same positive gate bias stress.

As described above, a meaning that the third transistor T3 and the fifth transistor T5 are submitted under same positive gate bias stress is to have same deterioration characteristic. A typical amorphous silicon thin film transistor has a characteristic that the threshold voltage is increased under the positive gate bias stress.

According to the present invention, the third transistor T3 and the fifth transistor T5 are arranged in adjacent position with each other so that their source terminals have same voltage. Thus, the third transistor T3 and the fifth transistor T5 have same deterioration characteristic. The threshold of the third transistor T3 and the fifth transistor T5 can be equally shifted. As a result, the voltage across the gate terminal of the fifth transistor T5 becomes the voltage the image information voltage for which the threshold voltage is compensated, thereby being capable of applying the current to the OLED.

As described above, according to the preferred embodiments of the present invention, the driving circuit and method can uniformly produce luminance of the light emitting element because the driving current is produced by compensating the unevenness threshold voltage of the active device (e.g., transistor).

Further, the variance of the threshold voltage $V_{th}$ due to deterioration of the transistor produced according as the driving circuit of the OLED is utilized for a long time is also compensated, thereby increasing life of the display device which applies the driving circuit of the OLED.

Further, if the pixel circuit included in the driving circuit of the OLED is applied to the OLED display device, a desired current flowing to the OLED of each pixel is controlled, thereby being capable of providing high quality of the image even case of high-precision display.

While the example embodiments of the present invention and their advantages have been described in detail, it should be understood that various changes, substitutions and alterations may be made herein without departing from the scope of the invention.

What is claimed is:

1. A driving circuit of an OLED including a scan line driving circuit configured to apply sequentially a selecting signal or an unselecting signal to a plurality of scan lines; a data line driving circuit configured to apply a voltage corresponding to image information to a plurality of data lines; and a pixel circuit arranged in each point where the scan lines and the data lines are intersected, wherein the pixel circuit comprises:

a first transistor of which a gate terminal is connected to a $[N-1]^{th}$ scan line $X_{N-1}$, and a drain terminal is connected to a power supply voltage $V_{DD}$;

a second transistor of which a drain terminal is connected to the source terminal of the first transistor, and a gate terminal is connected to a $N^{th}$ scan line $X_N$;

a third transistor of which a drain terminal is connected to the source terminal of the second transistor, and a gate terminal is connected to the source terminal of the first transistor and the drain terminal of the second transistor, a fourth transistor of which a gate terminal is connected to a $N^{th}$ scan line $X_N$, a drain terminal is connected to the data line $Y_M$, and a source terminal is connected to the source terminal of the third transistor;

a fifth transistor of which a drain terminal is directly connected without any intervening terminals to the source terminals of the third and fourth transistor, and a gate terminal is directly connected without any intervening terminals to a $[N-1]^{th}$ scan line $X_{N+1}$;

a sixth transistor of which a drain terminal is directly connected without any intervening terminals to the power supply voltage $V_{DD}$, a gate terminal is directly, connected without any intervening terminals to the source terminal of the first transistor, the drain terminal of the second transistor, and the gate terminal of the third transistor, and a source terminal is directly connected without any intervening terminals to the source terminal of the fifth transistor;

a capacitor of which one terminal is connected to the drain terminal of the sixth transistor and the power supply voltage $V_{DD}$, and the other terminal is connected to the source terminal of the first transistor, the drain terminal of the second transistor, the gate terminal of the third transistor and the gate terminal of the sixth transistor; and an OLED of which an anode terminal is connected to the sources of the fifth and sixth transistor.

2. The driving circuit of claim 1, wherein the $[N-1]^{th}$ scan line, the $N^{th}$ scan line and the $[N+1]^{th}$ scan line are sequentially selected, the $[N-1]^{th}$ scan line is a signal of a preceding pixel circuit, and the $[N+1]^{th}$ scan line is a signal of a latter pixel circuit.

3. A driving method of an OLED using a driving circuit of an OLED including a scan line driving circuit configured to apply sequentially a selecting signal or an unselecting signal to a plurality of scan lines; a data line driving circuit configured to apply a voltage corresponding to image information to a plurality of data lines; and a pixel circuit arranged in each point where the scan lines and the data lines are intersected, comprising:

charging a pre-charging voltage to gate terminals of a third and sixth transistor by a current applied from a power supply voltage $V_{DD}$, when only a first transistor is turned on by selecting a $[N-1]^{th}$ scan line $X_{N-1}$;

storing an image information voltage $V_{data}+V_{th}$ which adds a voltage $V_{data}$ corresponding to image information transmitted to a capacitor $C_{ST}$ via a data line $Y_M$ to a threshold voltage $V_{th}$, i.e., for which the threshold voltage is compensated, when a second and fourth transistor is only turned on by unselecting the $[N-1]^{th}$ scan line $X_{N-1}$ and selecting a $N^{th}$ scan line $X_N$, wherein the step of storing the image information voltage $V_{data}+V_{th}$, for which the threshold voltage $V_{th}$ is compensated, to the capacitor $C_{ST}$ comprises: transmitting the voltage $V_{data}$ corresponding to image information applied from the data line $Y_M$, which is connected to the drain terminal of the fourth transistor, to the source terminal of the third transistor via the fourth transistor; and discharging the pre-charging voltage $V_{precharging}$ charged to the gate terminals of the third and sixth transistor via the second, third and fourth transistor, and wherein the threshold voltage $V_{th}$ is a voltage between the gate terminal and the source terminal of the third transistor of which the source terminal is connected to the source terminal of the fourth transistor, and the gate terminals are connected to the terminal opposite to one terminal of the capacitor connected to the power supply voltage $V_{DD}$, when the current flowing to the third transistor is 1 nA to 10 nA; and supplying a current flowing to the OLED, when a fifth transistor is turned on by unselecting the $N^{th}$ scan line $X_N$ and selecting a $[N-1]^{th}$ scan line $X_{N+1}$ and the sixth transistor is turned on by the image information voltage for which the threshold voltage stored in the capacitor $C_{ST}$ is compensated.

* * * * *